United States Patent [19]

Goguen

[11] 4,292,703

[45] Oct. 6, 1981

[54] VENTILATED CUSHIONS

[76] Inventor: Clarence J. Goguen, 29 Redstone Hill Rd., Sterling, Mass. 01564

[21] Appl. No.: 13,465

[22] Filed: Feb. 21, 1979

[51] Int. Cl.[3] ..... A47C 27/00; B68G 7/00

[52] U.S. Cl. ..... 5/468; 5/472; 29/91.2

[58] Field of Search ..... 5/461, 467, 468, 469, 5/435, 472, 473, 417–420, 421, 423; 29/91, 91.1, 91.2; 297/453

[56] References Cited

U.S. PATENT DOCUMENTS 327,677 10/1885 Goutevenier ..... 5/468
3,216,028 11/1965 Lawson ..... 5/435
3,818,522 6/1974 Schuster ..... 5/468
4,125,911 11/1978 Moertel ..... 5/468

FOREIGN PATENT DOCUMENTS 195281 1/1938 Switzerland ..... 5/468

OTHER PUBLICATIONS

Offenlegungsschrift No. 1635 417–8/1970.

*Primary Examiner*—Alexander Grosz
*Attorney, Agent, or Firm*—Charles R. Fay

[57] ABSTRACT

An impervious cushion particularly adapted for scrap foam stuffing having vents comprising substantially imperceivable small slits in mutually spaced relation in the box edge between the upper and lower panels.

4 Claims, 6 Drawing Figures

VENTILATED CUSHIONS

BACKGROUND OF THE INVENTION

In some kinds of outdoor furniture it is advantageous to provide impervious cushions therefor, so that the same may be left out in the yard or patio over night and even in the rain without deterioration of the cushions.

These cushions are tufted usually by buttoning. That is buttons are applied at spaced points on the upper panel of the cushion and these are attached to retaining means at the lower panel thereof forming a tufted contour and appearance to the top panel.

In cases where a one piece cut-out sponge like foamed member is encased in the impervious covering, consisting of the upper and lower panels and connecting box edge, there is usually no buttoning; but in cases where less expensive scrap material of the spongy-foam nature is utilized buttoning is advantageous and it has been found that compressing the cushion for the buttoning process causes the air inside to be displaced abruptly in such a manner as to explode the covering thus ruining the cushion under manufacture.

Therefore, it has been the custom of the past to provide air vents for the cushion thus preventing the explosion. These air vents may be of different kinds but the most common one resides in the provision of a woven tape or the like sewed across a cut out slot in the box edging and having overlapping hemming. This is a very expensive part of the process of manufacture of the cushion and it is the object of the present invention to do away with this expensive sewed on vent as will become more apparent hereinafter.

SUMMARY OF THE INVENTION

In the present case top and bottom panels e.g. of vinyl, are connected in the usual manner by means of the box edging. The box edging has, however, previous to the attachment thereof, formed with a series of mutually spaced very fine small slits. These slits are substantially invisible because they are so small and can only be found by a rather determined effort to locate them, once the knowledge is imparted that such slits are present. It is preferred that these slits be in a sort of semi-circular arrangement or in V-shape or in U-shape such that a tiny flap is provided allowing venting of the accelerated X-pressure of air in the cushion during the buttoning process.

This invention reduces the cost of the cushion to a considerable extent because it avoids the expensive labor of sewing in the vent and therefore, a better cushion is provided at less expense.

Part of the invention is that the inventor has discovered that it is not necessary to remove material to have a functional and efficient vent preventing explosion during the buttoning process. The slits need be no greater and can be less than a quarter of inch in a box edge which is more than three inches wide, and also the slits may be spaced about four to six inches apart, to make an operative device according to the above-discussion, and to render the cushion substantially impervious, and more so than cushions with prior art vents.

PREFERRED EMBODIMENT OF THE INVENTION

In order to understand the present invention the prior art has to be understood also. In the present case a so-called impervious cushion is provided with a vinyl top panel 10 and a similar bottom panel 11, FIG. 6, connected by a box edge 12 having piping 14,16 connecting the same to the two panels. All the materials with the possible exception of the piping are of vinyl or some other pervious light weight material which is relatively resistant to ordinary wear and tear of cushions of outdoor furniture, e.g. red wood or metal types.

Figure 2:
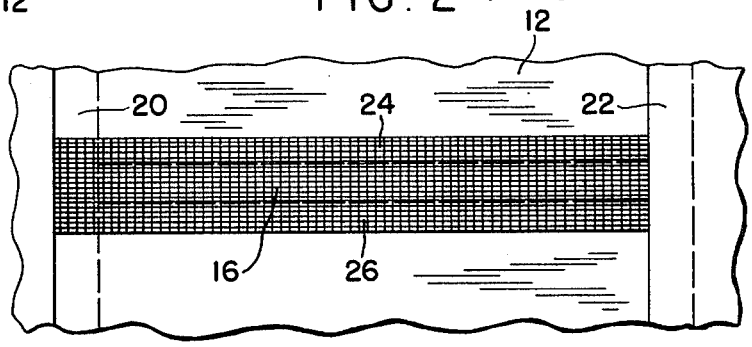
FIG. 2 PRIOR ART
FIG. 2 is a view in elevation illustrating the appearance of the vent of FIG. 1 at the inside of the cushion.

The cushion of the prior art is provided in the box edge with a vent. This vent is a strip of pervious material indicated at 16 and this is attached as for instance by sewing to the edges of a slot cutout of the box edge. Flaps or hems 18 are provided in an attempt to cover the vent and other tapes such as at 20,22 are ordinarily used to strengthen the construction, see also 24 and 26 in FIGURE 2 for instance.

It will be at once obvious that this is a relatively expensive sewing operation but as stated above it is absolutely necessary to provide these vents for shredded or scrap spongy foamed material stuffing which is actually preferable as far as comfort is concerned in the cushion, and at the same time, of course, it is a great deal less expensive than single cut out blocks of foam material to fit the size of the cushion to be made.

Figure 1:
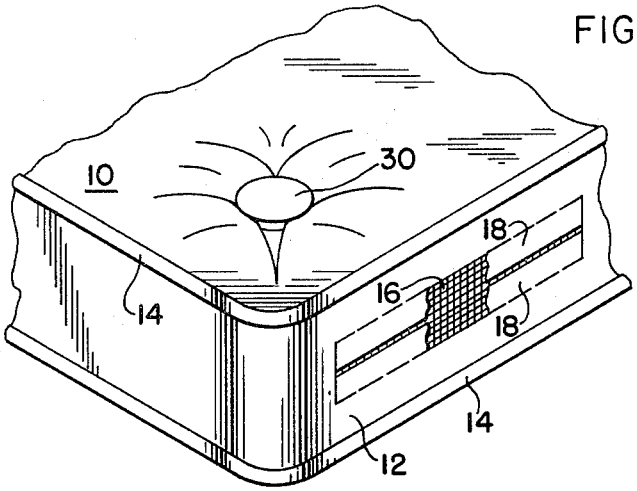
FIG. 1 PRIOR ART
FIG. 1 is a partial perspective view which illustrates the prior art vent in a cushion.
Figure 3:
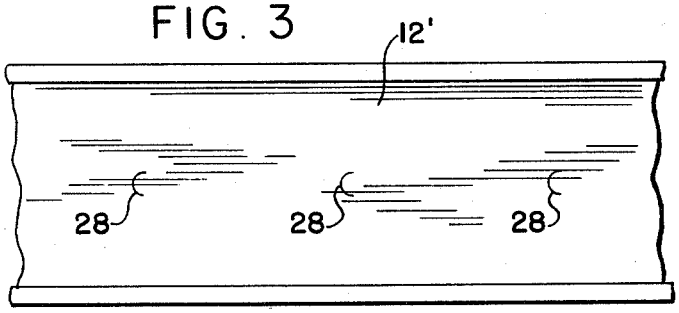
FIG. 3 is a view in elevation of the box edge showing the invention herein.
Figure 4:
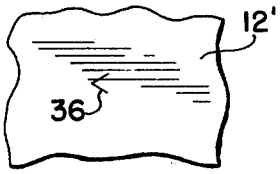
FIGS. 4 and 5 illustrate slight modifications thereof.
Figure 5:
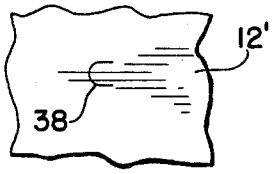

The present inventor has discovered, however, that by previously imparting a series of slits as at 28,28 to the box edging which is indicated in FIG. 3 as 12', vents are provided which completely obviate explosion in the buttoning process, a button being disclosed at 30 in FIG. 1. Also, there being no material removed, the cushion is still substantially impervious.

Figure 6:
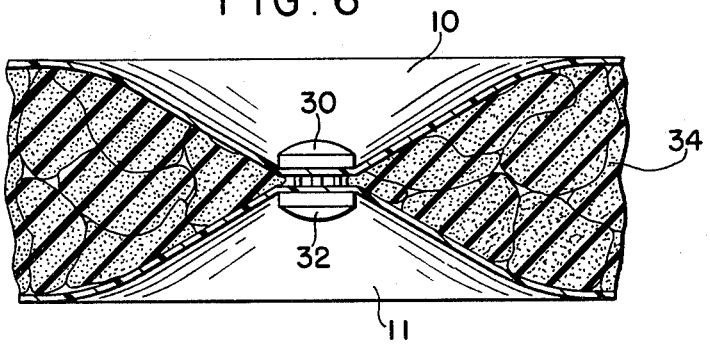
FIG. 6 is a section through the cushion at a button location.

This button is attached to a retainer 32 in the lower panel, which is indicated in FIG. 6, and it will be seen that this provides a relatively deep impression in the cushion making the same heavily tufted and much more confortable and at the same time preventing the filling or cushion material 34 from being displaced.

The slits 28 are preferably in the form of semi-circles but they may also be V-shaped as at 36, or in a U-shape form as at 38, while still carrying out the object of the invention.

The slits as shown herein provide small flaps which are at least partially displaceable by the air being expelled from the cushion during the buttoning process, and it will also be clear that by providing these slits by some form of automatic machinery, it is a great deal less expensive than the rather complicated application of the vent 16, the stitching necessary for the same, and the hold down tapes such as at 18 and 20, 22, 24 and 26 which are necessary therefor in the prior art.

I claim:

1. A tufted cushion comprising an enclosure including top and bottom flexible impervious panels, a connecting box edge of the same material.

compressible solid cushion filling material in the enclosure, and a series of buttons on one panel attached to fasteners on the other panel, forming deep tufting at spaced intervals throughout the cushion, mutually spaced slits about the box edge, said slits being very small compared to the width of the box edge and being almost invisible because of their small size and because no material of the box edge is removed, whereby explosion of the cushion in the buttoning process is obviated.

2. The cushion of claim 1 wherein the slits are curved and tend to form small flaps.

3. The cushion of claim 1 wherein the slits are less in length than one-tenth the width of the box edge.

4. The method of making a compressible solid material filled tufted cushion which includes flexible impervious top and bottom panels and a box edge, the box edge connecting the top and bottom panels, that improvement which comprises venting the cushion by providing a plurality of small slits in the box edge without the removal of any material of the box edge.

* * * * *